United States Patent [19]

Albers et al.

[11] Patent Number: 5,050,415

[45] Date of Patent: Sep. 24, 1991

[54] METHOD AND APPARATUS FOR ADJUSTING AND CHANGING THE HEIGHT OF THE PLANE OF PASSAGE OF THE MATERIAL TO BE ROLLED THROUGH ROLLS OF ROLLING STANDS OF A SHAPE ROLLING MILL

[75] Inventors: Jürgen Albers, Peine; Georg Engel, K-arst; Burkhard Porombka, Greverbroich, all of Fed. Rep. of Germany

[73] Assignee: SMS Schloemann-Siemag Aktiengesellschaft, Dusseldorf, Fed. Rep. of Germany

[21] Appl. No.: 419,823

[22] Filed: Oct. 11, 1989

[30] Foreign Application Priority Data

Oct. 11, 1988 [DE] Fed. Rep. of Germany ..... 3834587

[51] Int. Cl.[5] ..... B21B 37/08

[52] U.S. Cl. ..... 72/12; 72/225; 72/235; 72/237; 411/432; 411/917

[58] Field of Search ..... 72/199, 235, 237, 8, 72/9, 10, 11, 12, 225; 411/432, 434, 917

[56] References Cited

U.S. PATENT DOCUMENTS

| | | | |
|---|---|---|---|
| 287,008 | 10/1883 | Daniels | 72/238 |
| 2,571,265 | 10/1951 | Leufven | 411/434 |
| 3,212,314 | 10/1965 | Sieger | 72/239 |
| 3,251,213 | 5/1966 | Noda | 72/225 |
| 3,987,657 | 10/1976 | Properzi | 72/224 |
| 4,294,099 | 10/1981 | Spaude | 72/234 |
| 4,301,670 | 11/1981 | Engel et al. | 72/226 |
| 4,586,356 | 5/1986 | Frou et al. | 72/225 |
| 4,791,799 | 12/1988 | Engel et al. | 72/225 |
| 4,918,964 | 4/1990 | Engel et al. | 72/225 |
| 4,932,233 | 6/1990 | Bogendorfer | 72/225 |

FOREIGN PATENT DOCUMENTS

| | | | |
|---|---|---|---|
| 0291719 | 11/1988 | European Pat. Off. . | |
| 1239650 | 5/1967 | Fed. Rep. of Germany | 72/224 |
| 58-215207 | 12/1983 | Japan | 72/235 |
| 0007418 | 1/1984 | Japan | 72/237 |
| 0144502 | 8/1984 | Japan | 72/225 |
| 2100475 | 12/1982 | United Kingdom | 72/10 |

*Primary Examiner*—Lowell A. Larson
*Assistant Examiner*—Thomas C. Schoeffler
*Attorney, Agent, or Firm*—Toren, McGeady & Associates

[57] ABSTRACT

A method for adjusting and changing the heights of the plane of passage of a material being rolled through rolls of a rolling stand of a shape rolling mill including a flange upsetting stand arranged between two universal stand, the height adjustment for changing the plane of passage of the material being rolled being caused by raising or lowering the rolling stand or parts of the rolling stands carrying these rolls, and the height of the passage plane of the material being rolled through the rolls of this flange upsetting stand being controlled, changed and fixed in the course of the rolling operation for correcting the web central position of a shaped steel profile relative to the adjusted plane of passage of the remaining rolling stands.

3 Claims, 1 Drawing Sheet

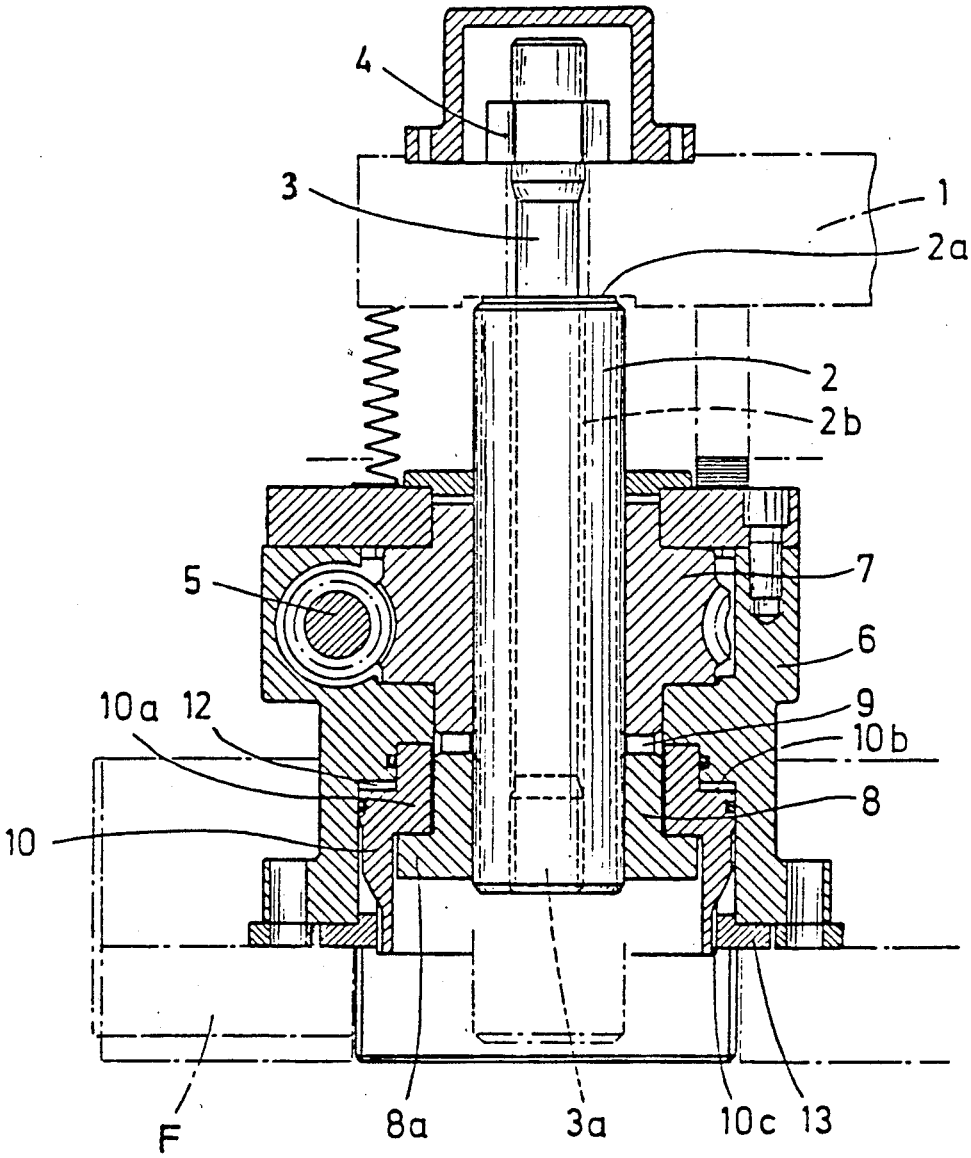
4
3
1
2a
2
2b
5
7
6
10a
12
9
10b
8
10
F
8a
3a
10c
13

METHOD AND APPARATUS FOR ADJUSTING AND CHANGING THE HEIGHT OF THE PLANE OF PASSAGE OF THE MATERIAL TO BE ROLLED THROUGH ROLLS OF ROLLING STANDS OF A SHAPE ROLLING MILL

BACKGROUND OF THE INVENTION

The invention relates to a method for adjusting and changing the height of the plane of passage of a material rolling through rolls of consecutively arranged rolling stands of a shape rolling mill, which stands include a flange upsetting stand arranged between two universal rolling stands. These adjustments are performed by raising or lowering the rolling stands and/or parts of the rolling stands supporting the rolls, as well as apparatus for performing the method.

The rolling of structural parts, especially girders or beams in shape rolling mills requires an accurate as possible observation of the inlet and outlet of the material to be rolled into the rolling gap at a right angle to the common roll axis plane of the top and bottom roll. This applies especially to universal rolling of girders having parallel flanges, since a deviation from these inlet conditions can change the position of the web center with respect to the rolling plane and thus cause a web mismatch impairing the quality of the finished product.

In universal rolling stands, one rolling gap is formed between the horizontal rolls and one rolling gap on each side of the respective vertical roll and the side flanks of the horizontal rolls facing the vertical roll. In case of an entry which is not at right angles, the girder section is constrained to climb into the rolling gap and is then raised by the bottom roll. The girder is aligned in the rolling gap and falls after its exit from the rolling gap approximately into the same height position corresponding to its entry. Herein the vertical rolls rotate around their vertical axes and cause, from the start of the deformation, an alignment of the material to be rolled into the mentioned position at right angles, meaning there occurs bending of the girder, which builds up the longitudinal stresses across the crosssection, which are felt in the lower flange halves as compressive stresses and in the upper flange halves as tensile stresses. The compressive stresses favor the lateral spread with thickness reduction of the flange, while the tensile stresses hinder the same, with the result that the lower flange halves widen more and the upper flange halves less or not at all. This different widening of the upper and lower flange halves leads to the quality impairing web mismatch.

In order to do away with these disadvantageous consequences of the rolling process, it has already been proposed to lift or lower the roll stand by means of shimstocks introduced between stands and base plates or also intermediate base plates and thus to assure a rectangular or correct entry angle for the material to be rolled. It is also known to use lifting devices placed beneath the stand instead of shimstock or (EP-patent application 88106436.4) to arrange the universal roll set consisting of a pair of horizontal rolls and a pair of vertical rolls so as to be vertically movable and positionally fixable within the universal rolling stand which is arranged to be stationary.

The described adaptations of the stand heights are performed prior to starting the rolling operation and are possibly corrected after rolling samples have passed through the stands. This requires considerable time expenditures and consequent down times of the rolling train. It has been shown to be particularly disadvantageous in that one experiences, for instance, a web center mismatch frequently during the rolling operation caused by change in the condition of the preliminary product, which makes it necessary to again stop the rolling train in order to perform the required corrections of the height position of the rolling stands.

SUMMARY OF THE INVENTION

Accordingly, it is an object of the present invention to provide a method and apparatus for adjusting and changing the material passage plane through rolls of roll stands which avoids the problems of the prior art methods and devices, and particularly avoid the down time problems thereof.

Pursuant to this object, and others which will become apparent hereafter, one aspect of the present invention resides in controllably changing and fixing the height of the passage plane of the material being rolled through the rolls of the flange upsetting stand relative to the adjusted plane of passage of the remaining rolling stands during the rolling operation, for correcting the web central position.

This change of the height position of the passage plane of the material to be rolled through the flange upsetting stand relative to the adjusted plane of passage, especially of the upstream and downstream universal stands, causes an upwards or downwards bending of the girder which is clamped between the universal stands. The compressive or tensile stresses arising in the flanges, depending on the direction of bending, overlay the deformation stresses in the rolling gap and thus, positively or negatively affect the lateral spread of these flanges.

Since the corrections by the method of the invention are caused by only relatively minor changes of the height position of the rolls of the flange upsetting stand, there exists no technical difficulty in performing these changes during the rolling operation with the use of known control devices. Thus, with appropriate determination of the dimensional deviation and dimensional changes of the rolled bar passing through the rolling train, the corrective adjustment can already be performed during its passage. The actuation values of such adjustments changing the height position can also be used as an adjustment link of a profile regulation or control, which actuating link automatically performs the adjustment of all remaining rolling stands of the rolling train during the rolling operation as a function of the dimensional deviations of the passing bar being rolled.

The method can, as is further provided in the invention be expediently performed by an arrangement wherein the flange upsetting stand is arranged in a known manner on positionally adjustable lifting devices or, in that both rolls of the two-high sets of rolls of the flange upsetting stand include a positioning arrangement for changing and fixing of these rolls in their vertical position, or in that the rolls of the two-high sets of rolls of the flange upsetting stands are respectively connected with an independent screw-down mechanism functioning independently of other adjusting devices.

If the shape rolling mill includes a compact reversing tandem group of stands, including one universal work stand, one flange upsetting stand and a universal finishing stand, then this universal tandem group of stands can be arranged upon a common support base plate supported by mechanically-hydraulically driven, positionally adjustable lifting devices. With this type of arrangement it is possible to vertically position the complete universal tandem group of stands during the passage of the rolled bars through the groove in such a way that the plane of passage and the conveyance plane of the rolling tables are matched to each other and the profiled bar passe through the universal reversing tandem group of stands lying in an unchanged plane. All this is accomplished without the necessity of matching the positions of the passage planes of the individual stands during a program change as also between individual rolling passes. The flange upsetting stand can in this case be arranged on the supporting base plate so as to be additionally adjustable in position.

The lifting device for the described arrangement includes, pursuant to the invention, a spindle drive whose spindle is additionally guided by the thread of a second pressure nut rotationally locked with the spindle nut and supported below the spindle wheel. The pressure nut is embraced by a sleeve type piston which is arranged in the spindle gear train housing so as to be axially displaceable, but non-rotational thereto.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawing.

BRIEF DESCRIPTION OF THE DRAWING

An embodiment of a lifting or elevating device pursuant to the present invention is depicted in the single drawing.

DETAILED DESCRIPTION OF THE PREFERRED EMBODIMENT

The support base plate 1 indicated in broken dotted lines rests on the end face 2*a* of a threaded spindle 2 and is screwed together therewith by means of a tie bolt 3 with threaded extension 3*a* and nut 4, with the tie bolt passing through a central threaded bore 2*b*. The threaded spindle 2 is guided by means of mating threads in a worm pinion 7 supported in a spindle gearing housing 6. The worm pinion 7 is rotatably driveable and positionally controllable by a motor designed for instance as a stepped drive motor (not depicted here) acting through an endless worm gear 5. A thrust nut 8 is supported below the worm pinion 7, which is rotationally coupled with the worm pinion 7 by means of a claw or dog clutch 9 and which is embraced by a sleeve type piston 10, which rests by means of an inside annular collar 10*a* upon an outer annular collar 8*a* of the thrust nut 8. This sleeve type piston 10 is guided in the spindle gearing housing 6 in the direction of the central axis of the thrust nut 8 and can be acted upon in an non-depicted manner by a pressure agent by means of an annular chamber 12 formed above the annular face 10*b* pointing upwards and being part of the sleeve type piston 10. The sleeve type piston 10 comprises circumferential guide spline grooves 10*c* parallel to its central axis, which engage into spline guide pieces 13 which are adjustably bolted to the spindle gearing housing 6 and which fix the sleeve type piston 10 non-rotatably in the spindle gearing housing 6. The support base plate 1 is lifted or lowered into a desired position by the threaded spindle 2 through the worm screw 5 and the worm pinion 7. After reaching this position the base plate 1 is fixed by action of a pressure agent upon the sleeve type piston 10 and with this the thrust nut 8. This fixation in the spindle gearing housing 6 connected with the foundation F, is free of play.

While the invention has been illustrated and described as embodied in a method and apparatus for adjusting and changing the height of the passage plane of a material to be rolled through rolls of rolling stands of a shape rolling mill, it is not intended to be limited to the details shown, since various modifications and structural charges may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

1. An arrangement for adjusting and changing the height of a plane of passage of a material being rolled through rolls of consecutive rolling stands in a rolling train of a shape rolling mill, which train includes a flange upsetting stand between two universal stands, the arrangement comprising:

means for raising and lowering at least one of, the rolling stands and parts of the rolling stands containing the rolls, as the material rolls through the rolls of the rolling stands;

means for controlling, changing and fixing the height of the plane of passage of the material as it rolls through the rolls of the flange upsetting stand during a rolling operation, so that a web central position relative to an adjusted plane of passage through the remaining rolling stands can be corrected, said raising and lowering means including positionally adjustable elevating devices, said flange upsetting stand being arranged upon said elevating devices, said raising and lowering means including a common support baseplate located upon elevating devices which are driven in a mechanical-hydraulic manner and which are positionally adjustable, the universal stands being arranged on said common supports; and measuring means for determining measured values of dimensional deviations of the rolled bar passing through the rolling train, the thus determined measured values being used to change the height adjustment.

2. An arrangement for adjusting and changing the height of a plane of passage of a material being rolled through rolls of consecutive rolling stands in a rolling train of a shape rolling mill, which train includes a flange upsetting stand between two universal stands, the arrangement comprising:

means for raising and lowering at least one of, the rolling stands and parts of the rolling stands containing the rolls, as the material rolls through the rolls of the rolling stands; and means for controlling, changing and fixing the height of the plane of passage of the material as it rolls through the rolls of the flange upsetting stand during a rolling operation, so that a web central position relative to an adjusted plane of passage through the remaining rolling stands can be corrected, said raising and lowering means including positionally adjustable elevating devices, said flange upsetting stand being arrange upon said elevating devices, the elevating device including a spindle gear having a threaded spindle (2) additionally guided by means of threads in a second thrust nut (8) located below a worm pinion (7) and rotationally coupled therewith, the thrust nut being embraced by a sleeve-type piston (10) which is arranged so as to be rotationally locked with and axially displaceable in a housing of the spindle gearing.

3. An arrangement as defined in claim 2, wherein the sleeve-type piston (10) has an inner annular collar (10*a*) which rests upon an outer annular collar (8*a*) of the thrust nut (9) and comprises on its circumference guide spline grooves (10*c*) parallel to the central axis, which engage detachably into spline guide pieces (13) arranged at the spindle gearing housing (6).

* * * * *